US005786686A

United States Patent [19]

Ohtake

[11] Patent Number: 5,786,686

[45] Date of Patent: Jul. 28, 1998

[54] LOW-POWER CONSUMPTION TYPE SEMICONDUCTOR DEVICE

[75] Inventor: Hisao Ohtake, Tokyo, Japan

[73] Assignee: Oki Electric Industry Co., Ltd., Tokyo, Japan

[21] Appl. No.: 780,847

[22] Filed: Jan. 9, 1997

[30] Foreign Application Priority Data

Aug. 30, 1996 [JP] Japan ..... 8-229523

[51] Int. Cl.[6] ..... G05F 1/40

[52] U.S. Cl. ..... 323/282; 323/288

[58] Field of Search ..... 323/282, 313; 307/482, 109, 594, 473, 246, 584; 327/544

[56] References Cited

FOREIGN PATENT DOCUMENTS

07038417 A 2/1995 Japan .

*Primary Examiner*—Peter S. Wong

*Assistant Examiner*—Rajnikant B. Patel

*Attorney, Agent, or Firm*—Spencer & Frank

[57] ABSTRACT

An internal circuit reduces power consumption when it is in a non-operation standby state (power-down state). A switch means is provided between an internal circuit and a power supply to reduce power consumed by a semiconductor device even if a subthreshold current flows within the internal circuit of a semiconductor integrated circuit. The switch means has the function of substantially providing non-continuity between the internal circuit and the power supply in response to a control signal inputted from an external terminal when the internal circuit is in a non-operation mode.

13 Claims, 5 Drawing Sheets

Illustration of First Embodiment of the Present Invention

Illustration of First Embodiment of the Present Invention

Illustration of Second Embodiment of the Present Invention

Illustration of Control Circuit in the Second Embodiment of the Present Invention Illustration of Third Embodiment of the Present Invention Illustration of Fourth Embodiment of the Present Invention

LOW-POWER CONSUMPTION TYPE SEMICONDUCTOR DEVICE

BACKGROUND OF THE INVENTION

1. Field of the Invention

This invention relates to a low-power consumption type semiconductor device and a semiconductor integrated circuit.

2. Description of the Related Art

In a conventional semiconductor device or semiconductor integrated circuit having an internal circuit, the source voltage or the threshold of each MOS transistors that constitute the internal circuit has been reduced to achieve low power consumption. With the decrease in the source voltage or its threshold, the power consumption has been lowered while the operating function of the internal circuit is being maintained.

As a proposal related to this type of technique, one invention is known which has been disclosed in, for example, Japanese Patent Application Laid-Open No. 7(1995)-38417.

In the conventionally-proposed configuration, however, the threshold voltage of each MOS transistor constituting the internal circuit has been set low. Therefore, a subthreshold current (also called "leakage current,") produced even when the voltage applied to the gate of of the MOS transistor is lower than the threshold voltage, increases. Thus, even if the internal circuit is placed in an operation standby state (power-down state), power consumption increases eventually.

SUMMARY OF THE INVENTION

In the present invention, a switch means is provided between an internal circuit and a power supply to reduce power to be consumed by a semiconductor device even when a subthreshold current is produced within the internal circuit of the semiconductor device. The switch means has the function of substantially providing non-conduction between the internal circuit and the power supply in response to a control signal supplied from an external terminal when the internal circuit is put into a non-operation mode.

Further, the switch means and the internal circuit are respectively composed of MOS transistors. The width of the gate of a MOS transistor that constitutes the switch means is formed so as to be sufficiently greater than the width of the gate of each MOS transistor of the internal circuit.

Moreover, a control circuit for generating the control signal may be disposed between the external terminals supplied with data and the switch means. The control circuit is also electrically connected to the power supply.

Typical embodiments of the present invention will be shown in brief. However, the various embodiments of the present invention and specific configurations of these embodiments will be understood from the following description.

BRIEF DESCRIPTION OF THE DRAWINGS

While the specification concludes with claims particularly pointing out and distinctly claiming the subject matter which is regarded as the invention, it is believed that the invention, the objects, features of the invention and further objects, features and advantages thereof will be better understood from the following description taken in connection with the accompanying drawings in which:

DETAILED DESCRIPTION OF THE PREFERRED EMBODIMENTS

Figure 1:
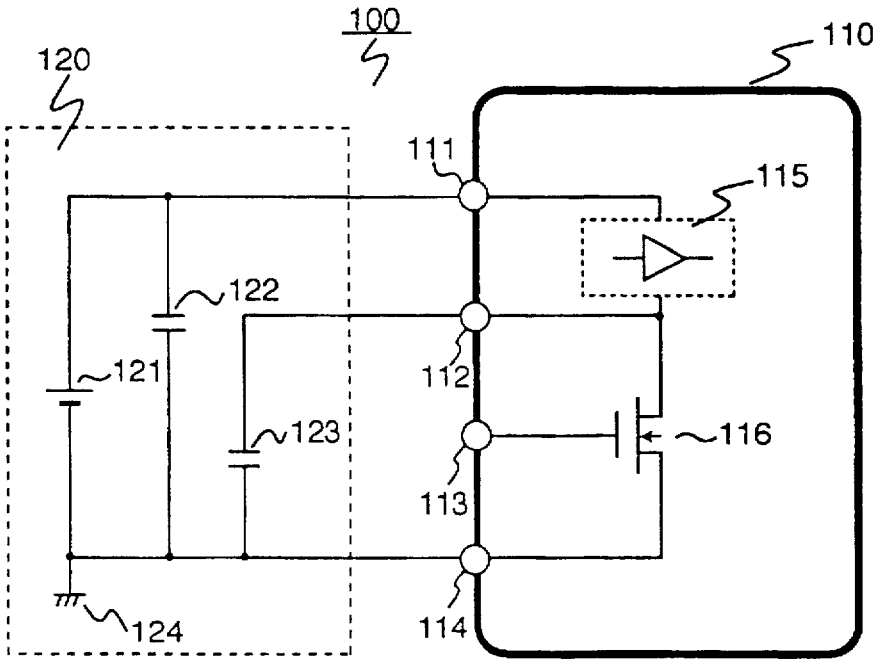
FIG. 1 is a circuit diagram showing a first embodiment of the present invention.

Preferred embodiments of the invention according to the present application will hereinafter be described with reference to the accompanying drawings. The drawings employed in this description are schematically illustrated to help the understanding of the present invention. Elements of structure similar to one another in the respective drawings are identified by the same reference numerals and symbols and the description of certain common elements will be omitted whenever superfluous.

A first embodiment will first be described with reference to FIG. 1.

A power-saving circuit arrangement 100 comprises a semiconductor integrated circuit 110 and a power unit 120 that is independent of the semiconductor integrated circuit 110. The present embodiment shows the case in which the power unit 120 is provided outside the semiconductor integrated circuit 110. However, it is also considered that the power unit 120 may be provided inside the semiconductor integrated circuit 110.

The semiconductor integrated circuit 110 comprises a power terminal 111 supplied with a drive potential VDD from the power unit 120, a virtual ground terminal 112 supplied with a reference potential VSS through a capacitive means 123 from the power unit 120, a control terminal 113 supplied with an external control signal, and a ground terminal 114 supplied with the reference potential from the power unit 120. An internal circuit 115 is electrically connected between the power terminal 111 and the virtual ground terminal 112, and a switch means 116 is provided between the internal circuit 115 and the ground terminal 114 and is activated so as to substantially provide non-conduction or discontinuity between the internal circuit 115 and the ground terminal 114 in response to the external control signal supplied to the control terminal 113. Of the plurality of external terminals referred to above, only the aforementioned four terminals directly related to the present invention will be described. The description of other external terminals will be omitted. Although various forms are considered as the configuration of the internal circuit 115, its configuration is typically illustrated in FIG. 1 by way of example. In the following description, the state in which the internal circuit 115 exerts its effect or function and the state in which the internal circuit 115 stops its function and is on standby, will be described as an operating state and a non-operating state respectively.

In the present embodiment, the switch means 116 comprises an N type MOS transistor (hereinafter called "NMOS"), gate electrode of the NMOS transistor is supplied with the external control signal through the control terminal 113. The width of the gate of the NMOS 116 is set in such a manner that the voltage applied to the drain of the NMOS 116 is not raised even when current consumed in the operating state of the internal circuit 115 flows through the NMOS 116. Described specifically, the gate width of the NMOS 116 may be suitably set such that the voltage applied to the drain of the NMOS 116, i.e., the voltage applied to the virtual ground terminal 112, falls within 0.1 V. In the present embodiment, the gate width of the NMOS 116 is far greater than any gate widths of MOS transistors that constitute the internal circuit 115 and is set so as to be sufficiently smaller than the sum of the gate widths of the MOS transistors of the internal circuit 115.

The power unit 120 generates a d.c. current and comprises a power supply 121 whose positive electrode is electrically connected to the power terminal 111 and whose negative electrode is electrically connected to a ground power or potential 124, a capacitive means 122 electrically connected in parallel to the power supply 121 between the power terminal 111 and the ground potential 124 and used as a bypass capacitor, and the capacitive means 123 electrically connected between the virtual ground terminal 112 and the ground potential 124 and used as a bypass capacitor. Although the capacitive values of these capacitive means 122 and 123 are normally set to large values, these values can be suitably selected by a designer. In the present embodiment, the power supply 121 comprises a battery.

The operation of the circuit arrangement 100 will next be described.

When the internal circuit 115 enters the operating state, an external control signal of a high level (corresponding to the same potential level as the level of the drive potential VDD in this case) is first supplied to the control terminal 113 so that the NMOS 116 is brought into conduction. The potential at the virtual ground terminal 112 becomes a potential (substantially 0 V) equivalent to the reference potential VSS (VSS=0 V in this case) supplied to the ground terminal 114. As a result, the reference potential is supplied to the internal circuit 115 so that the internal circuit 115 is brought into the normal operating state. In this case, noise produced at the power terminal 111 due to the operation of the power supply 121 and the internal circuit 115 is removed by the capacitive means 122. Further, noise developed at the virtual ground terminal 112 due to the operation of the internal circuit 115 is canceled by the capacitive means 123.

Next, when the internal circuit 115 is brought into the non-operating state, the external control signal supplied to the control terminal 113 is changed to a low level (corresponding to the same potential level as the level of the reference potential VSS in this case), so that the NMOS 116 is brought into a non-conducting state.

Owing to the provision of the NMOS 116 referred to above, even if a subthreshold current would other wise flow in the internal circuit 115 while in its non-operating state due to the fact that the threshold of each MOS transistor in the internal circuit 115 is set to a low value (e.g., about 0.2 V), the subthreshold current can be prevented from flowing because the NMOS 116 is held in a non-conduction state. Accordingly, the current to be used up by the semiconductor device 100 when the internal circuit 115 is in the non-operating state can be sufficiently reduced. As a result, a low-power consumption type semiconductor device can be realized.

Now, the NMOS 116 itself is also considered to have the potential for generation of the subthreshold current. However, since the gate width of the NMOS 116 is sufficiently larger than the gate width of each transistor in the internal circuit 115 and is set so as to be sufficiently smaller than the sum of the gate widths of the respective transistors in the internal circuit 115, the subthreshold current is extremely small even if such a subthreshold current is produced.

According to the first embodiment of the present invention referred to above, current consumption during the non-operating state of the semiconductor device equipped with the internal circuit having transistors with low thresholds, can be sufficiently reduced. The effect of providing low power consumption is greatly reflected by applying such a configuration to a device with a low voltage source such as a battery or the like used as a power supply.

Figure 2:
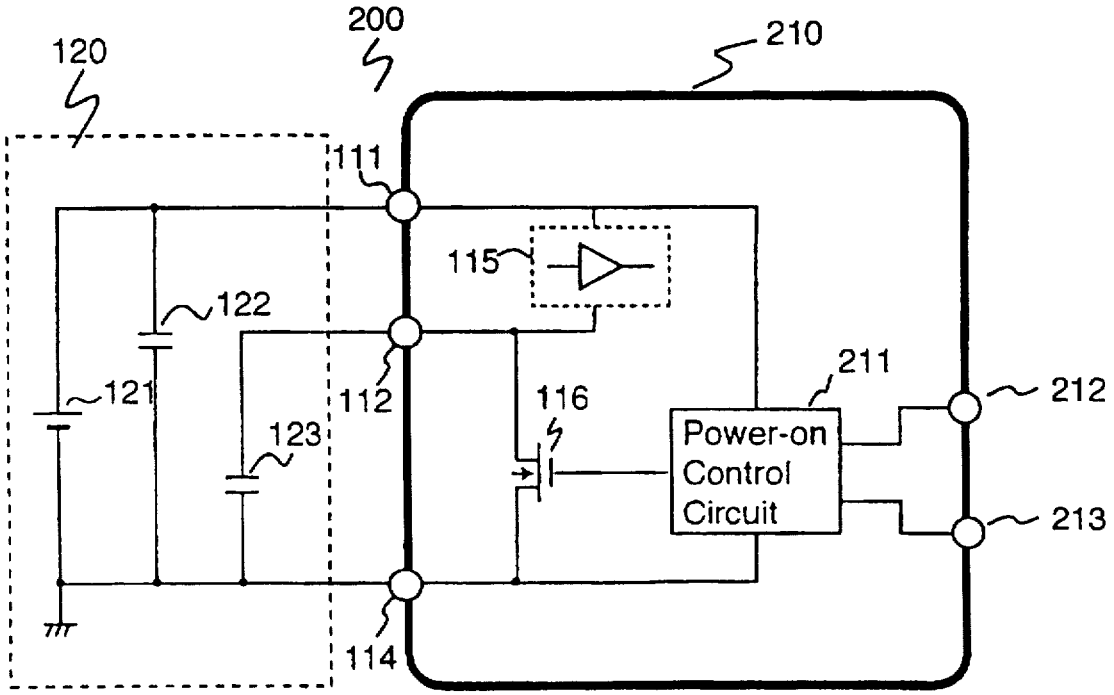
FIG. 2 is a circuit diagram illustrating a second embodiment of the present invention.

A second embodiment of the present invention will next be described with reference to FIGS. 2 and 3. In this case, the same elements as those employed in the first embodiment are identified by the same reference numerals and symbols and the description of certain common elements will be omitted.

In the second embodiment, a power-saving circuit arrangement 200 of the type wherein the inside of the semiconductor integrated circuit 110 employed in the first embodiment has been improved into a semiconductor integrated circuit 210, is illustrated. The semiconductor integrated circuit 210 is provided with a power-on control circuit 211 for controlling an NMOS 116 in response to an internal control signal. The power-on control circuit 211 is controlled based on external control signals supplied to input terminals 212 and 213. Although only the input terminals 212 and 213 are shown in FIG. 2, the number of input terminals to be required differs or varies according to a circuit configuration of the power-on control circuit 211.

The power-on control circuit 211 is electrically connected between the power terminal 111 and the ground terminal 114. An input of the power-on control circuit 211 is electrically connected to the input terminals 212 and 213. The power-on control circuit 211 is composed of a logic circuit formed by utilizing flip-flops, NAND gates, etc. in combination. A specific configuration of the logic circuit will be described later.

The operation of the circuit arrangement 200 will next be described in brief.

When an internal circuit 115 enters into an operating state, the power-on control circuit 211 first outputs an internal control signal of a high level (corresponding to the same potential level as the level of a drive potential VDD in this case) therefrom in response to the external control signals supplied to the input terminals 212 and 213 so as to bring the NMOS 116 into a conducting state. Further, the potential at the virtual ground terminal 112 becomes a potential (substantially 0 V) equivalent to the reference potential VSS (VSS=0 V in this case) supplied to the ground terminal 114. As a result, the reference potential is supplied to the internal circuit 115 so that the internal circuit 115 is brought into the normal operating state.

Next, when the internal circuit 115 enters a non-operating state, the internal control signal output by the power-on control circuit 211 outputs an internal changes to a low level (corresponding to the same potential level as the reference potential VSS in this case) in response to the external control signals supplied to the input terminals 212 and 213 so as to bring the NMOS 116 into a non-conducting state.

Figure 3:
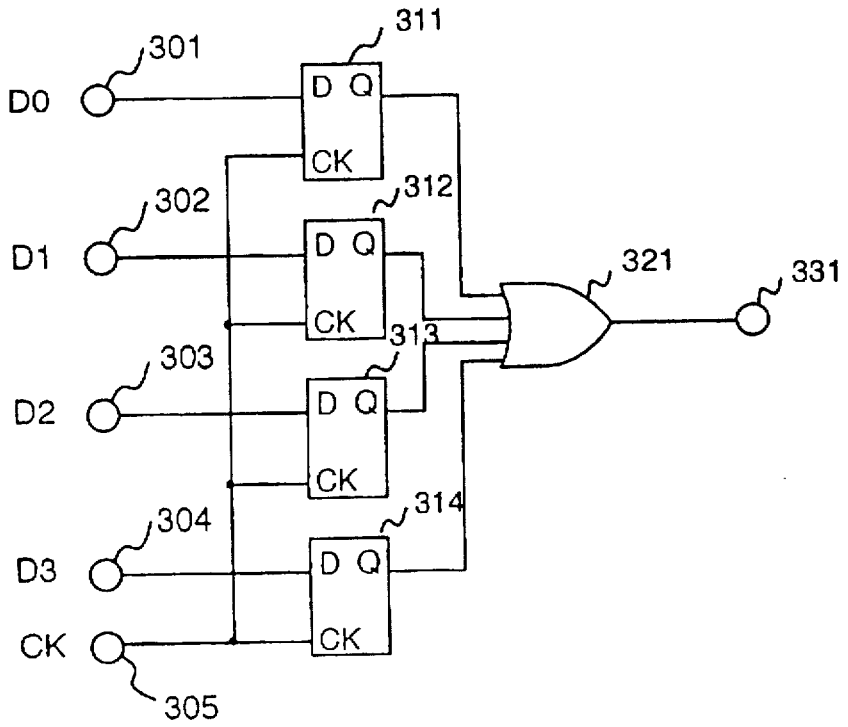
FIG. 3 is a circuit diagram showing an example of a power-on control circuit employed in the second embodiment of the present invention.

Now, the configuration of a power-on control circuit 300 corresponding to a specific example of the power-on control circuit 211 is shown in FIG. 3.

The power-on control circuit 300 includes D type flip-flops 311 through 314 respectively supplied with data D0 through D3 corresponding to the aforementioned external control signals from input terminals 301 through 304 and a clock signal CK from an input terminal 305, and a gate circuit 321 for ORing outputs produced from the flip-flops 311 through 314 and outputting an internal control signal to an output terminal 331. An example in which the input terminals 301 through 305 have been used is illustrated herein. However, the number of terminals to be used depends on the configuration of the power-on control circuit.

The operation of the power-on control circuit 300 can be easily understood if consideration is given to the following description and the description of the operation of the above-described power-on control circuit 200.

The data D0 through D3 supplied to the input terminals 301 through 304 are latched in their corresponding flip-flops 311 through 314 when the clock signal CK applied to the input terminal 305 rises. Thereafter, outputs Q produced from the flip-flops 311 through 314 are supplied to the gate circuit 321 from which the OR of the outputs Q is supplied to the output terminal 331 as the internal control signal. The output terminal 331 is electrically connected to a switch means 116 (NMOS 116 in the present embodiment).

When the internal circuit 115 is in the non-operating state, the data D0 through D3 are low in level and are supplied to their corresponding input terminals 301 through 304 and are further latched in their corresponding flip-flops 311 through 314. Thereafter, low-level signals are respectively outputted from outputs Q of the flip-flops 311 through 314 when the clock signal CK rises. Since the outputs Q of the flip-flops 311 through 314 are low in level, the output produced from the gate circuit 321, i.e., the internal control signal, is also rendered low in level. The NMOS 116 is brought into its non-conduction state in response to the low-level internal control signal.

On the other hand, when the internal circuit 115 is placed in the operating state, combined data D0 through D3 (e.g., D0 high in level and D1 through D3 low in level) other than those whose all levels are low, are respectively supplied to the input terminals 301 through 304 and are further latched in their corresponding flip-flops 311 through 314. Thereafter, signals (e.g., output Q of the flip-flop 311, which is high in level and outputs of the flip-flops 312 through 314, which are low in level) of mixed high and low levels are respectively outputted from the outputs Q of the flip-flops 311 through 314 when the clock signal CK rises. Since the outputs Q of the flip-flops 311 through 314 are those whose high and low levels are mixed together, the output from the gate circuit 321, i.e., the internal control signal, is rendered high in level. Thus, the NMOS 116 is brought into conduction in response to the high-level internal control signal.

According to the second embodiment provided with such a power-on control circuit, the following advantageous effect can be expected in addition to the advantageous effect obtained in the first embodiment. Namely, when the internal circuit 115 is in the non-operating state (switch means 116 is off), a leakage current is produced from the internal circuit 115 so that the potential at the virtual ground terminal 112 is raised. Thus, since the power-on control circuit 211 is directly connected between the power terminal 111 and the ground terminal 114 even if it is difficult to perform the normal operation of the internal circuit 115, the power-on control circuit 211 can perform its proper operation without being perfectly affected by the leakage current.

Namely, the switch means 116 is accurately controlled by the external control signals supplied to the input terminals 212 and 213. It is thus possible to suitably shift the internal circuit 115 from the non-operating state to the operating state.

Owing to the provision of the power-on control circuit in this way, a semiconductor device can be realized which is capable of reliably executing the transition from one mode to another mode and providing a stable operation.

Figure 4:
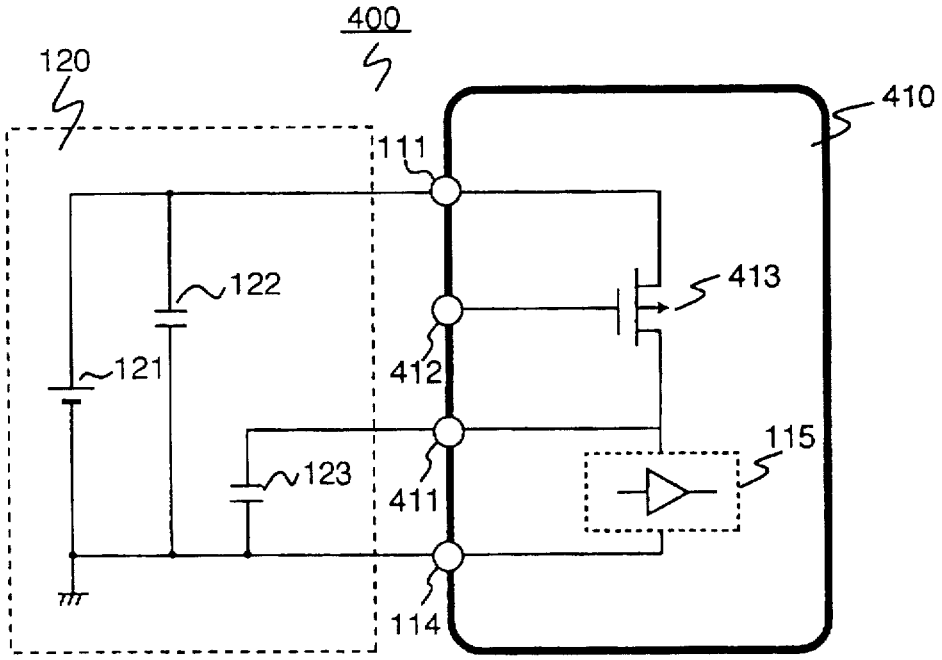
FIG. 4 is a circuit diagram illustrating a third embodiment of the present invention.
Figure 5:
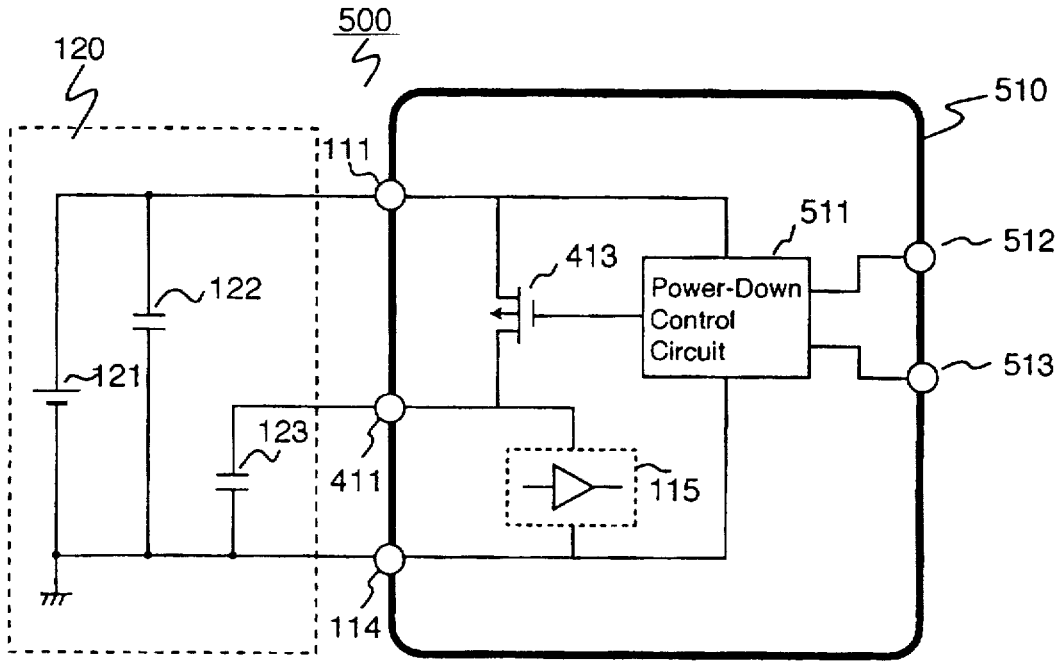
FIG. 5 is a circuit diagram depicting a fourth embodiment of the present invention.

Third and fourth embodiments of the present invention will next be described with reference to FIGS. 4 and 5. In the first and second embodiments described above, the switch means 116 is composed of an NMOS transistor. In the following third and fourth embodiments, however, each switch means is composed of a P channel type MOS transistor (hereinafter called "PMOS"). The NMOSs employed in the first and second embodiments are basically replaced by the PMOSs employed in the third and fourth embodiments. The following third and fourth embodiments can be easily understood if consideration is given to the descriptions of the first and second embodiments. Therefore, the third and fourth embodiments will be explained in brief.

The third embodiment will first be described with reference to FIG. 4.

A semiconductor device 400 comprises a semiconductor integrated circuit 410 and a power unit 120 that is independent of the semiconductor integrated circuit 410.

The power-saving circuit arrangement 410 comprises a power terminal 111 supplied with a drive potential VDD from the power unit 120, a virtual power terminal 411 supplied with a reference potential VSS through a capacitive means 123 from the power unit 120, a control terminal 412 supplied with an external control signal, a ground terminal 114 supplied with the reference potential VSS from the power unit 120, an internal circuit 115 electrically connected between the ground terminal 114 and the virtual power terminal 411, and a switch means 116 provided between the internal circuit 115 and the power terminal 111 and activated so as to substantially provide non-conduction or non-continuity between the internal circuit 115 and the power terminal 111 in response to the external control signal supplied to the control terminal 412. Of the plurality of external terminals referred to above, only the aforementioned four terminals related directly to the present invention will be described in the same manner as the aforementioned embodiment. The description of other external terminals will be omitted. Although various forms are considered as the configuration of the internal circuit 115, its configuration is typically illustrated in FIG. 4 by way of example. In the following description, the state in which the internal circuit 115 exerts its effect or function, and the state in which the internal circuit 115 stops its function and is on standby, will be described as an operating state and a non-operating state respectively.

In the present embodiment, the switch means 116 comprises a PMOS 413. The external control signal is supplied to a gate electrode of the PMOS from the control terminal 412. The width of the gate of the PMOS 413 is suitably set by reference to the description of the first embodiment described above.

The operation of the semiconductor device 400 will next be described.

When the internal circuit 115 enters the operating state, the control terminal 413 is first supplied with an external control signal of a low level (corresponding to the same potential level as the level of the reference potential VSS in this case) so that the PMOS 413 is brought into conduction. The potential at the virtual power terminal 411 becomes a potential equivalent to the drive potential VDD supplied to the power terminal 111. As a result, the drive potential is supplied to the internal circuit 115 so that the internal circuit 115 is brought into the normal operating state.

Next, when the internal circuit 115 is brought into the non-operating state, the control terminal 412 is supplied with an external control signal of a high level (corresponding to the same potential level as the level of the drive potential VDD in this case) so that the PMOS 413 is brought into a non-conducting state.

Owing to the provision of the PMOS 413 referred to above, even if a subthreshold current flows in the internal circuit 115 upon its non-operating state due to the fact that the threshold of each MOS transistor in the internal circuit 115 is set to a low value (e.g., about 0.2 V), the subthreshold current can be prevented from flowing because the PMOS 413 is held in non-conduction. Accordingly, the current to be used up by the semiconductor device 400 when the internal circuit 115 is in the non-operating state, can be sufficiently reduced. As a result, a low-power consumption type semiconductor device can be realized.

According to the third embodiment of the present invention referred to above, the current consumption at the time of the non-operating state of the semiconductor device equipped with the internal circuit having the transistors low in threshold, can be sufficiently reduced in a manner similar to the first embodiment. The effect of providing low power consumption is greatly reflected by applying such a configuration to a device with a low voltage source such as a battery or the like used as a power supply.

The fourth embodiment of the present invention will next be described with reference to FIG. 5.

In the fourth embodiment, a power-saving circuit arrangement 500 of the type wherein the inside of the semiconductor integrated circuit 410 employed in the third embodiment has been improved into a semiconductor integrated circuit 510, is illustrated. The semiconductor integrated circuit 510 is provided with a power-down control circuit 511 for controlling a PMOS 413 based on an internal control signal. The power-down control circuit 511 is controlled based on external control signals supplied to input terminals 512 and 513. Although only the input terminals 512 and 513 are shown in FIG. 5, the number of input terminals to be required differs or varies according to a circuit configuration of the power-down control circuit 511.

The power-down control circuit 511 is electrically connected between a power terminal 111 and a ground terminal 114. An input unit of the power-down control circuit 511 is electrically connected to the input terminals 512 and 513. The power-down control circuit 511 is composed of a logic circuit formed by utilizing flip-flops, NAND gates, etc. in combination.

The operation of the semiconductor device 500 will next be described in brief.

When an internal circuit 115 enters into an operating state, the power-down control circuit 511 first outputs an internal control signal of a low level (corresponding to the same potential level as the level of a reference potential VSS in this case) therefrom in response to the external control signals supplied to the input terminals 512 and 513 so as to bring the PMOS 413 into a conducting state. Further, the potential at a virtual power terminal 411 becomes a potential (substantially 5 V) equivalent to a drive potential VDD (VDD=5 V in this case) supplied to the power terminal 111. As a result, the drive potential is supplied to the internal circuit 115 so that the internal circuit 115 is brought into the normal operating state.

Next, when the internal circuit 115 enters a non-operating state, the power-down control circuit 511 outputs an internal control signal of a high level (corresponding to the same potential level as the level of the drive potential VDD in this case) in response to the external control signals supplied to the input terminals 512 and 513 so as to bring the PMOS 116 into a non-conducting state.

The power-down control circuit 511 employed in the present embodiment can be also realized by utilizing, for example, a circuit configuration in which the control signals supplied to the power-on control circuit 211 employed in the second embodiment or the logic of the output of the power-on control circuit 211 is reversed.

The operation of the circuit arrangement 500 will next be described in brief.

When the internal circuit 115 enters into an operating state, the power-down control circuit 511 first outputs an internal control signal of a low level (corresponding to the same potential level as the level of a ground potential VSS in this case) therefrom in response to the external control signals supplied to the input terminals 512 and 513 so as to bring the PMOS 413 into a conducting state. Further, the potential at the virtual power terminal 411 becomes a potential (substantially 5 V) equivalent to the drive potential VDD (VDD=5 V in this case) supplied to the power terminal 111. As a result, the drive potential is supplied to the internal circuit 115 so that the internal circuit 115 is brought into the normal operating state.

Next, when the internal circuit 115 enters a non-operating state, the power-down control circuit 511 outputs an internal control signal of a high level (corresponding to the same potential level as the level of the drive potential VDD in this case) in response to the external control signals supplied to the input terminals 512 and 513 so as to bring the PMOS 413 into a non-conducting state.

According to the fourth embodiment provided with such a power-down control circuit, the same advantageous effect as that obtained by the above-described second embodiment can be obtained.

The above-described embodiments show, as an example, the case in which the internal circuit and the power-on control circuit or the power-down control circuit are constructed independently of each other. However, it is also considered that the output of the power-on control circuit or the power-down control circuit is supplied to the internal circuit or the output of the internal circuit is supplied to the power-on control circuit or the power-down control circuit.

While the present invention has been described with reference to the illustrative embodiments, this description is not intended to be construed in a limiting sense. Various modifications of the illustrative embodiments, as well as other embodiments of the invention, will be apparent to those skilled in the art on reference to this description. It is therefore contemplated that the appended claims will cover any such modifications or embodiments as fall within the true scope of the invention.

According to the invention of the present application, as has been described above, a current to be consumed by a semiconductor device at the time of a non-operating state of the semiconductor device provided with an internal circuit having transistors each low in threshold, can be sufficiently reduced. The effect of providing low power consumption is remarkably reflected by applying such a construction to a device with a low voltage source such as a battery or the like used as a power supply.

Further, according to another aspect of the present invention, the transition from one mode to another mode can be reliably executed by providing a control circuit for controlling a switch means within a semiconductor integrated circuit. It is thus possible to realize a stable semiconductor device.

What is claimed is:

1. A power-saving circuit arrangement, comprising:

a power supply having a drive potential terminal for supplying a drive potential therefrom and having a reference potential terminal for supplying a reference potential that is lower than the drive potential therefrom;

capacitive means connected to said reference potential terminal; and a semiconductor integrated circuit which includes a first external terminal connected to said drive potential terminal;

a second external terminal connected to said capacitive means;

an internal circuit connected between said first external terminal and said second external terminal and having an operation mode in which a functional operation of said internal circuit is performed by said internal circuit and a non-operation mode in which the function of said internal circuit is substantially stopped;

a third external terminal connected to said reference potential terminal;

a fourth external terminal supplied with a control signal having a first logic level when said internal circuit is to be placed in the non-operation mode, the control signal having a second logic level when said internal circuit is to be placed in the operation mode; and a switching circuit disposed between said internal circuit and said third external terminal and activated in response to the control signal so as to substantially provide non-conduction between said internal circuit and said third external terminal when said control signal has said first logic level and so as to provide conduction between said internal circuit and said third external terminal when said control signal has said second logic level, said internal circuit receiving power for operation thereof when said switching circuit provides conduction between said internal circuit and said third external terminal.

2. A circuit arrangement according to claim 1, wherein said internal circuit and said switching circuit are respectively composed of MOS transistors and the width of a gate of each MOS transistor of said switching circuit is greater than the width of a gate of each MOS transistor of said internal circuit.

3. A semiconductor integrated circuit comprising:

a first external terminal supplied with a drive potential;

a second external terminal supplied with a reference potential that is lower than the drive potential;

an internal circuit connected to said first external terminal and having an operation mode in which a functional operation of said internal circuit is performed by said internal circuit and a non-operation mode in which the function of said internal circuit is substantially stopped;

a third external terminal supplied with a control signal having a first logic level or a second logic level; and a switching circuit disposed between said internal circuit and said second external terminal and activated in response to said control signal so as to substantially provide non-conduction between said internal circuit and said second external terminal when said control signal has said first logic level and so as to provide conduction between said internal circuit and said second external terminal when said control signal has said second logic level, said internal circuit receiving power for operation thereof when said switching circuit provides conduction between said internal circuit and said second external terminal.

4. A semiconductor integrated circuit according to claim 3, wherein said internal circuit and said switching circuit are respectively composed of MOS transistors and the width of a gate of each MOS transistor of said switching circuit is greater than the width of a gate of each MOS transistor of said internal circuit.

5. A power-saving circuit arrangement, comprising:

a power supply having a drive-potential terminal for supplying a drive potential therefrom and having a reference potential terminal for supplying a reference potential that is lower than the drive potential therefrom;

capacitive means connected to said reference potential terminal; and a semiconductor integrated circuit which includes a first external terminal connected to said drive potential terminal;

a second external terminal connected to said capacitive means;

a third external terminal connected to said reference potential terminal;

an internal circuit connected between said third external terminal and said second external terminal and having an operation mode in which a functional operation of said internal circuit is performed by said internal circuit and a non-operation mode in which the function of said internal circuit is substantially stopped;

a fourth external terminal supplied with a control signal having a first logic level when said internal circuit is to be placed in the non-operation mode, the control signal having a second logic level when said internal circuit is to be placed in the operation mode; and a switching circuit disposed between said internal circuit and said first external terminal and activated in response to said control signal so as to substantially provide non-conduction between said internal circuit and said first external terminal when said control signal has said first logic level and so as to provide conduction between said internal circuit and said first external terminal when said control signal has said second logic level, said internal circuit receiving power for operation thereof when said switching circuit provided conduction between said internal circuit and said first external terminal.

6. A circuit arrangement according to claim 5, wherein said internal circuit and said switching circuit are respectively composed of MOS transistors and the width of a gate of each MOS transistor of said switching circuit is greater than the width of a gate of each MOS transistor of said internal circuit.

7. A semiconductor integrated circuit comprising:

a first external terminal supplied with a drive potential;

a second external terminal supplied with a reference potential that is lower than the drive potential;

an internal circuit connected to said second external terminal and having an operation mode in which a functional operation of said internal circuit is performed by said internal circuit and a non-operation mode in which the function of said internal circuit is substantially stopped;

a third external terminal supplied with a control signal having a first logic level or a second logic level; and a switching circuit disposed between said internal circuit and said first external terminal and activated in response to said control signal so as to substantially provide non-conduction between said internal circuit and said first external terminal when said control signal has said first logic level and so as to provide conduction between said internal circuit and said first external terminal when said control signal has said second logic level, said internal circuit receiving power for operation thereof when said switching circuit provides conduction between said internal and said first external terminal.

8. A semiconductor integrated circuit according to claim 7, wherein said internal circuit and said switching circuit are respectively composed of MOS transistors and the width of a gate of each MOS transistor of said switching circuit is greater than the width of a gate of each MOS transistor of said internal circuit.

9. A semiconductor integrated circuit comprising:

a first external terminal supplied with a drive potential;

a second external terminal supplied with a reference potential that is lower than the drive potential;

an internal circuit connected to one of said first and second external terminals; and a switching circuit which is responsive to a control signal having a first logic level or a second logic level, said switching circuit being connected to the other of said first and second external terminals and to said internal circuit, said switching circuit providing non-conduction between said internal circuit and said other of said first and second external terminals when said control signal has said first logic level and providing conduction between said internal circuit and said other of said first and second external terminal when said control signal has said second logic level, said internal circuit receiving power for operation thereof when said switching circuit provides conduction between said internal circuit and said other of said first and second external terminals.

10. integrated circuit according to claim 9, wherein said internal circuit and said switching circuit are respectively composed of MOS transistors and the width of a gate of each MOS transistor of said switching circuit is greater than the width of a gate of each MOS transistor of said internal circuit.

11. A semiconductor integrated circuit according to claim 9, further comprising a plurality of additional external terminals, and control circuit means connected to said first and second external terminals and to said additional external terminals, for generating said control signal in response to data supplied to said additional external terminals.

12. A semiconductor integrated circuit according to claim 11, wherein said control circuit means comprises means for OR-ing said data supplied to said additional external terminals.

13. A semiconductor integrated circuit according to claim 12, wherein said control circuit means further comprises means for latching said data supplied to said additional external terminals before they are OR-ed.

* * * * *